US008851112B2

(12) United States Patent
Nelson

(10) Patent No.: US 8,851,112 B2
(45) Date of Patent: Oct. 7, 2014

(54) DUAL CONFIGURATION HYDRAULIC MANIFOLD APPARATUS AND SYSTEM

(75) Inventor: Travis Nelson, Calgary (CA)

(73) Assignee: 1566618 Alberta Ltd., Calgary (CA)

( * ) Notice: Subject to any disclaimer, the term of this patent is extended or adjusted under 35 U.S.C. 154(b) by 194 days.

(21) Appl. No.: 13/466,939

(22) Filed: May 8, 2012

(65) Prior Publication Data

US 2013/0299020 A1 Nov. 14, 2013

(51) Int. Cl.
*F16K 31/02* (2006.01)

(52) U.S. Cl.
USPC ..... 137/596.17; 137/625.65; 137/565.11; 91/508; 91/519; 91/520

(58) Field of Classification Search
CPC ..... F15B 11/205; F15B 11/22; F15B 13/021; F15B 13/043; F15B 15/18; F15B 2211/305; F15B 2211/31; E02F 9/225; E02F 9/2285
USPC ..... 137/596.17, 625.65, 565.11; 91/508, 91/519, 520, 522–523
See application file for complete search history.

(56) References Cited

U.S. PATENT DOCUMENTS

| | | | | |
|---|---|---|---|---|
| 217,991 | A * | 7/1879 | Coburn | 91/508 |
| 2,256,144 | A * | 9/1941 | Gifford et al. | 60/471 |
| 3,073,123 | A * | 1/1963 | Hodgson et al. | 60/424 |
| 3,543,645 | A * | 12/1970 | Baatrup | 91/519 |
| 3,768,263 | A * | 10/1973 | Olson et al. | 60/425 |
| 5,224,411 | A * | 7/1993 | Fillion | 91/525 |
| 5,255,590 | A * | 10/1993 | Klemm | 91/516 |
| 5,911,245 | A * | 6/1999 | Weber | 137/625.65 |
| 6,318,235 | B1 * | 11/2001 | Allart et al. | 91/491 |
| 7,090,475 | B2 * | 8/2006 | Shrive | 417/426 |
| 2009/0032752 | A1 * | 2/2009 | Nagasaki | 251/129.15 |
| 2012/0199771 | A1 * | 8/2012 | Kasagi et al. | 251/129.15 |

* cited by examiner

*Primary Examiner* — Elizabeth Houston
*Assistant Examiner* — Minh Le
(74) *Attorney, Agent, or Firm* — Bennett Jones LLP

(57) ABSTRACT

The invention relates to a hydraulic manifold apparatus and system, connectable to a dual stage motor, for use in the topdrive of drilling operations. The hydraulic manifold is switchable between a low speed, high torque configuration and a high speed, low torque configuration. Valves within the manifold control the flow of working fluid through the manifold and into and out of the motor. Switching means are further provided to control the opening and closing of the valves. In the low speed, high torque configuration, working fluid enters each stage of the dual motor simultaneously, in parallel. In the high speed, low torque configuration, working fluid enters a first stage of the motor, returns to the hydraulic manifold, then enters a second stage of the motor, before returning again to the hydraulic manifold. Thus during high speed, low torque operation, working fluid enters each stage of the dual motor in series.

20 Claims, 7 Drawing Sheets

DUAL CONFIGURATION HYDRAULIC MANIFOLD APPARATUS AND SYSTEM

FIELD OF THE INVENTION

The prevent invention relates to control equipment for powering hydraulic motors used in oil well drilling, and more particularly to a dual configuration hydraulic manifold operatively connected to a dual stage motor for use in the topdrive of drilling operations. The hydraulic manifold is switchable from a low speed, high torque configuration to a high speed, low torque configuration.

BACKGROUND

Downhole drilling requires a mechanism for rotating a drillstring. Traditionally, this rotation was created by a rotary table. However, rotary tables have largely been replaced by topdrives, which have the advantage of permitting the drilling to be done with three joint strands rather than a one joint strand.

Hydraulically-powered motors are typically used (although electric motors may instead be used) to rotate the topdrive and thereby impart rotation to the drillstring. Typically, in the case of a hydraulic motor, a pump pressurizes and circulates working fluid through a manifold, which controls fluid flow into the motor of the topdrive.

In two-speed prior art control systems for hydraulic motors using a four-port motor having two fluid intakes and two fluid outputs, the hydraulic fluid may be simultaneously be pumped into the motor's two intakes and out through the motor's two outputs. This arrangement is used when low speed, high torque is required from the motor, for example when the drill is moving through high density substances. Alternatively, when the drill is moving through low density substances, the motor is run at high speed, low torque. However, during high speed, low torque operation, the manifold is typically arranged so that one of the manifold intakes and one of the manifold outputs is "dead ended". This disadvantageously results in a loss of energy due to vicious flow, creation of heat, and friction loss.

A real need thus exists for a hydraulic motor control that is capable of providing working fluid to a hydraulic motor that operates at low speed, high torque or at high speed, low torque, and that can switch between the two operating conditions without power loss.

SUMMARY OF THE INVENTION

The invention provides an improved hydraulic manifold for use in the topdrive of a drilling operation, the manifold having two alternatively-selectable configurations, which provide working fluid to a motor operating in either a low speed, high torque configuration or a high speed, low torque configuration.

Accordingly, in one broad aspect of the present invention, the invention comprises a hydraulic manifold apparatus operable in a low speed, high torque configuration or a high speed, low torque configuration, said hydraulic manifold apparatus comprising:

a supply port adapted to receive pressurized working fluid from a hydraulic pump;

a first and second output port connectable to an intake of a hydraulic motor;

a first and second intake port connectable to an output of said hydraulic motor;

a first, second, and third actuable valve for controlling the flow of said working fluid through said hydraulic manifold apparatus;

actuation means for controlling said first, second, and third valves in said hydraulic manifold apparatus between a first configuration for low speed, high torque operation wherein said first actuable valve and said third actuable valve are open and said second actuable valve is closed, and a second configuration for high speed, low torque operation wherein said second actuable valve is open and said first actuable valve and said third actuable valve are closed; and a return port adapted to deliver working fluid to said hydraulic pump;

wherein in said first configuration, said working fluid exits said hydraulic manifold apparatus through said first output port and said second output port simultaneously and returns into said hydraulic manifold apparatus through said first intake port and said second intake port simultaneously to permit low speed, high torque operation of said hydraulic motor, and wherein in said second configuration, said working fluid exits said hydraulic manifold apparatus through said first output port, returns into said hydraulic manifold apparatus through said first intake port, exits said hydraulic manifold apparatus through said second output port, and returns into said hydraulic manifold apparatus through said second intake port to permit high speed, low torque operation of said hydraulic motor.

In a further broad aspect of the invention, the invention comprises a hydraulic control system for controlling a topdrive motor in a drilling operation, comprising:

a supply means for receiving pressurized working fluid from a pump;

a first and second output means for connection to an intake of a hydraulic motor;

a first and second intake means constructed and arranged for connection to an output of said hydraulic motor;

a first, second, and third valve means;

actuation means for configuring said hydraulic manifold system between a first configuration wherein said first valve means and said third valve means are open while said second valve means is closed and a second configuration wherein said second valve means is open and said first valve means and said third valve means is closed;

a return means adapted to return working fluid to said pump;

wherein in said first configuration, said working fluid exits said hydraulic control system through said first output means and said second output means simultaneously and returns into said hydraulic control system through said first intake means and said second intake means simultaneously to permit low speed, high torque operation of said hydraulic motor, and in said second configuration, said working fluid exits said hydraulic control system through said first output means, returns into said hydraulic control system through said first intake means, exits said hydraulic control system through said second output means, and returns into said hydraulic control system through said second intake means to permit high speed, low torque operation of said hydraulic motor.

In still a further broad aspect of the invention, the invention comprises a hydraulic manifold operable in a low speed, high torque configuration or high speed, low torque configuration, said hydraulic manifold comprising:

a supply port adapted to receive pressurized working fluid from a pump;

a first and second output port connectable to an intake of a hydraulic motor;

a first and second intake port connectable to an output of said hydraulic motor;

a first, second, and third actuable valve for controlling the flow of said working fluid through said hydraulic manifold;

a first, second, and third electrical actuator for actuating said first actuable valve, said second actuable valve, and said third actuable valve, respectively, and a return port adapted to deliver working fluid to said pump;

wherein in said low speed, high torque configuration, said second actuable valve is closed and said first electrical actuator and said third electrical actuator actuate said first actuable valve and said third actuable valve, respectively, to open said first valve and said third valve and in said high speed, low torque configuration, said first actuable valve and said third actuable valve are closed and said second electrical actuator actuates said second actuable valve to open said second actuable valve.

DETAILED DESCRIPTION OF PREFERRED EMBODIMENTS

Figure 1:
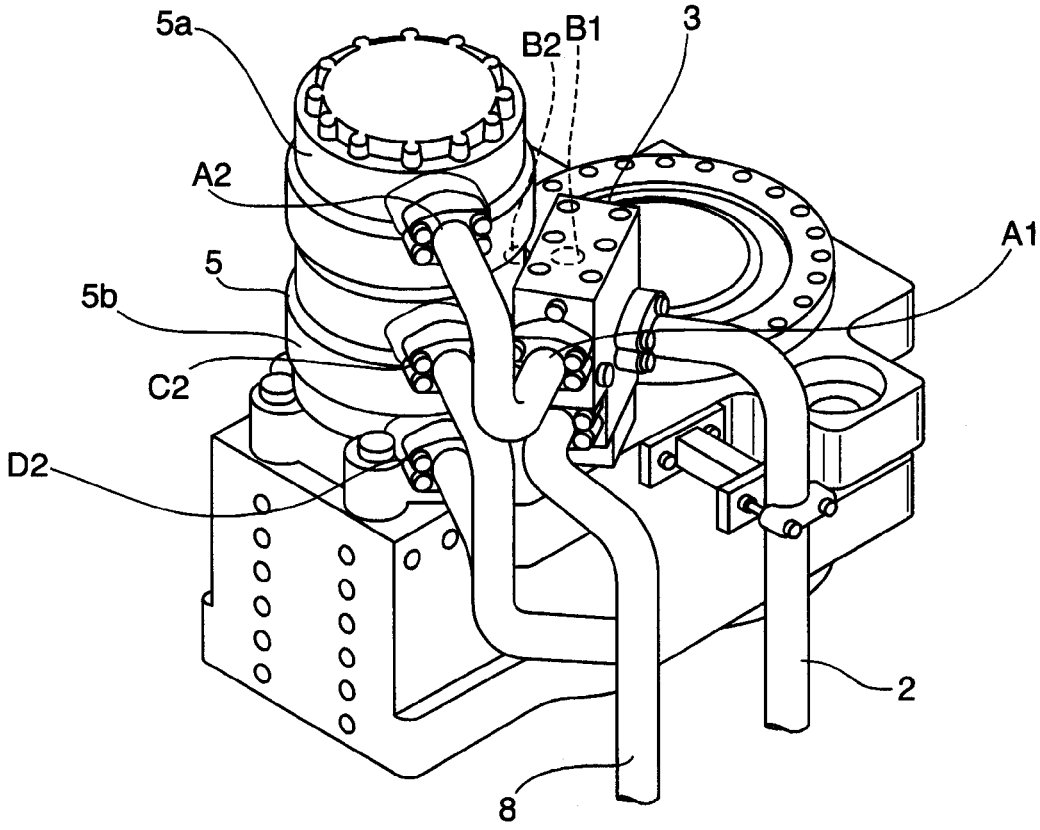
Fig.1 Prior Art
FIG. 1 is a side view of a topdrive unit of the prior art; comprising a control manifold and a hydraulically powered motor.

Referring to FIG. 1, a prior art hydraulic system 1 is shown. The hydraulic system 1 comprises a hydraulic fluid pump (not shown) for supplying pressurized hydraulic fluid, a hydraulic manifold 3 for receiving said pressurized hydraulic fluid, and a motor unit 5 comprising two motors 5*a*, 5*b* that drives a topdrive unit (not shown). The hydraulic manifold 3 receives pressurized working fluid from the pump via supply port 2, and returns working fluid to the pump via return port 8. The prior art hydraulic manifold 3 comprises two output ports, A1 and B1, which are operationally connectable to two intake ports, A2 and B2, respectively on motor unit 5. The motor unit 5 additionally comprises two output ports, C2 and D2, which are operatively connectable to hydraulic return port 8, which is in fluid communication with the hydraulic fluid pump (not shown).

The prior art hydraulic system 1 of FIG. 1 may be operated in a low speed, high torque configuration. In this configuration, working fluid exits the hydraulic manifold 3 through output ports A1 and E1 on the manifold 3 and enters the motor 5 through the intake ports A2 and B2, respectively, on motor 5. Once the working fluid has circulated through the motor 5, it exits through output ports C2 an D2 on motor 5 and is returned to the pump via return 8.

The prior art hydraulic system 1 may also be operated in a high speed, low torque configuration. In this configuration hydraulic fluid flow out of one of the output ports A1 on the manifold 3 is "dead ended" so that working fluid is pumped through hydraulic manifold 3 through only one output B1 to motor unit 5. Correspondingly, once the working fluid has circulated through the motor 5, it exits the motor 5 through only one output. Accordingly, fluid continues to circulate within the entire motor unit 5, and in particular both of motors 5*a*, 5*b* even though only one motor 5*a* or 5*b* is receiving pressurized hydraulic fluid from manifold 3. This disadvantageously results in a loss of energy due to viscous flow, the creation of heat, and friction loss.

In other prior art hydraulic systems (not shown), working fluid that has circulated through a motor is returned to the manifold through two different intake ports on the manifold. When said system is operating at high speed, low torque, one of the intake ports on the manifold is similarly "dead ended" so that the working fluid is returned to the manifold through only one port. This again likewise disadvantageously results in a loss of energy due to viscous flow, the creation of heat, and friction loss within the motor of a two motor system which is not receiving pressurized hydraulic fluid and is effectively "dead ended".

Figure 2:
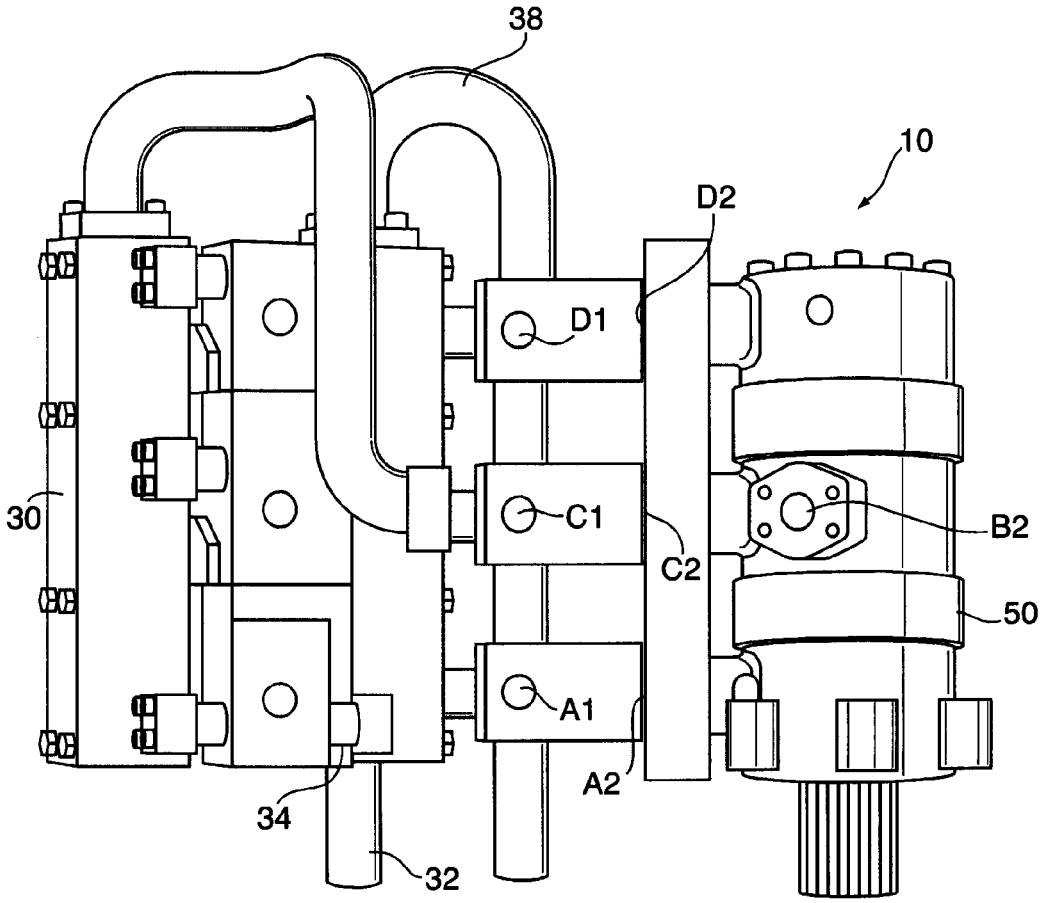
FIG. 2 is an exploded side view of an embodiment of the hydraulic control manifold of the present invention, showing its connection to a hydraulic motor.

Referring to FIG. 2, FIG. 2 shows an embodiment of an inventive dual configuration hydraulic manifold system 10 of the present invention. The hydraulic system 10 comprises a pump (not shown), a hydraulic manifold 30, and a motor unit 50, comprising two motors 50*a*, 50*b*, stacked one on top of the other and coupled together on a common shaft (not shown). The hydraulic manifold 30 receives pressurized working fluid from the pump via connector 32 and intake means 34. The pressure of the fluid will depend on the torque requirements of motor unit 50, and may be as high as 5,000 psi. After circulating through the motor 50 and returning to the hydraulic manifold 30 (as described below), working fluid is returned to the pump through output 36 and connector 38.

The hydraulic manifold 30 comprises four ports for mating with the motor unit 50, two output ports A1 and C1 and two intake ports B1 and D1. Ports A1, C1, and D1 are preferably arranged linearly in a vertical plane with port B1 positioned adjacent to port C1.

Motor unit 50 is preferably a dual stage motor, i.e. containing two motors 50*a*, 50*b* on one shaft in a single casing. A motor unit 50 of this type, for example is a four port, 125 series double stack motor, code 62, supplied from Rineer Hydraulics, Inc.®. The motor 50 comprises four ports for mating with manifold 30, two intake ports A2 and C2, in operational connection with hydraulic manifold 30 output ports A1 and C1, respectively, and two output ports B2 and D2, in operational connection with hydraulic manifold 30 intake ports B1 and D1. Ports A2, C2, and D2 are preferably arranged linearly in a vertical plane with port B2 positioned adjacent to port C2.

The hydraulic manifold 30 further comprises three internal valves 31, 33, 35 (not visible in FIG. 2, but described further below and shown in FIGS. 3A, 3B, 4A, 4B, 5A, and 5B) which permit the hydraulic manifold 30 to switch between a low speed, high torque configuration and a high speed, low torque configuration, and without having to replace or exchange the hydraulic manifold 30 or motor unit 50. Preferably, valves 31, 33, 35 comprise ball valves, but may contain any other type of valves known to a person of skill in the art, including a solenoid actuated ball valve, gate valve, butterfly valve or the like. For example, valves 31, 33, 35 may each comprise solenoid actuated ball valves, comprising 24-volt solenoids operating such ball valves and contained in an explosion proof container.

Figure 3A:
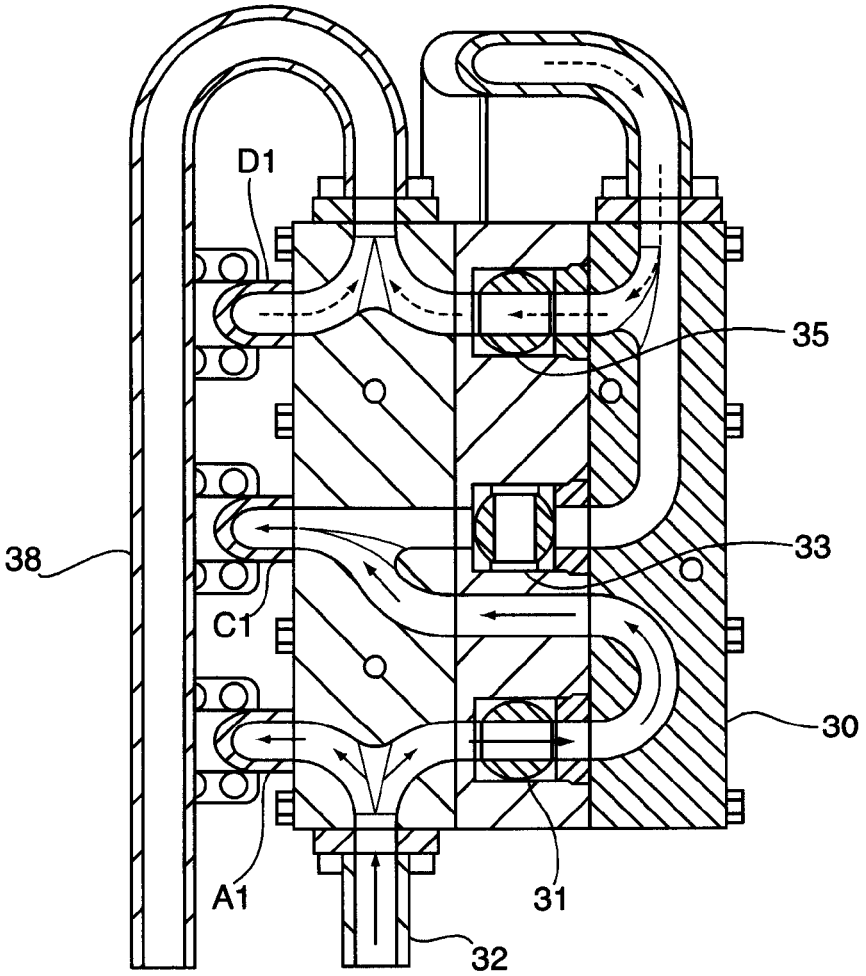
FIG. 3A is a cross section of an embodiment of a hydraulic manifold of the invention according to FIG. 2, in a low speed, high torque configuration.

Referring to FIG. 3A, the hydraulic manifold 30 is shown operating in a low speed, high torque configuration. As described above, the hydraulic manifold 30 contains valves 31, 33, and 35, which control the flow of working fluid through hydraulic manifold 30 and thereby into motor unit 50. Valves 31, 33, and 35 are preferably aligned linearly in a vertical fashion within manifold 30, as shown in FIGS. 3A and 3B.

In the low speed, high torque configuration, with reference to FIG. 2 and FIG. 3A, valves 31 and 35 are actuated to be open while valve 33 is actuated to be closed. Working fluid from the pump enters manifold 30 through connector 32 and intake 34 (shown in bolded arrows). With valve 33 closed, pressurized hydraulic fluid flows through manifold 30 and through both output ports A1 and C1 and into corresponding intake ports A2 and C2, respectively, on motor unit 50. Working fluid therefore enters both motor 50*a* via output port A2 and motor 50*b* via output port B2 and thus in parallel. After circulating through motors 50*a*, 50*b* the fluid flows (shown in stippled arrows) through output ports B2 and D2 on motors 50*a*, 50*b* respectively and into intake ports B1 and D1, respectively of manifold 30. With valve 35 open and valve 33 closed, the working fluid returned from the motor unit 50 moves through the manifold 30 and through output 36 into connector 38 to be returned to the pump.

Figure 3B:
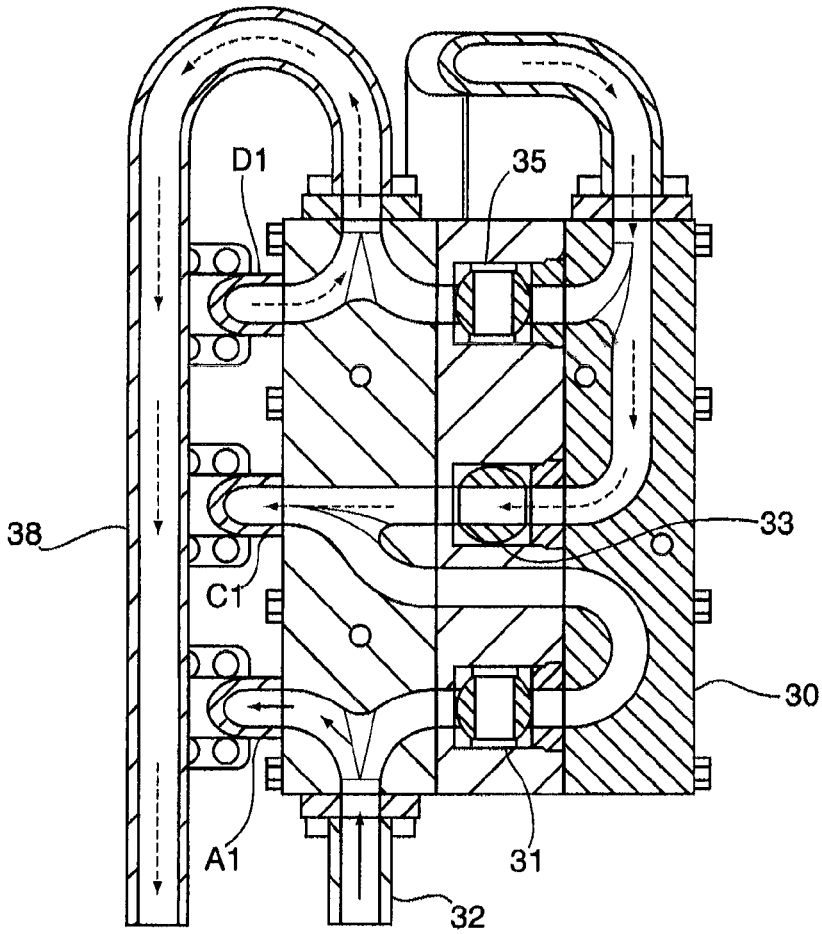
FIG. 3B is a cross section of an embodiment of a hydraulic manifold of the invention according to FIG. 2, in a high speed, low torque configuration.

Referring to FIGS. 2 and 3B, the hydraulic manifold 30 is shown operating motor unit 50 in a high speed, low torque configuration. In this configuration, valve 33 is open and valves 31 and 35 are closed. Working fluid from the pump enters manifold 30 through connector 32 and intake 34 (shown in bolded arrows). With valve 31 actuated to the closed position, the working fluid flows through manifold 30 and through output port A1 and into corresponding intake port A2 on motor 50*a*. After circulating through a first motor 50*a*, the fluid flows through output port B2 on motor unit 50 and into intake port B1 of manifold 30. With valve 33 actuated open and valve 35 actuated closed, the working fluid (shown in dashed arrows) then flows through output port C1 and into corresponding intake port C2 on motor 50*b*. After circulating through motor 50*b*, the fluid flows through output D2 on motor 50*b* and into intake port D1 on manifold 30 (shown in dotted arrows). With valve 35 actuated closed, the fluid returned from the motor 50*b* moves through the manifold 30 and through output 36 into connector 38 to be returned to the pump. Therefore, during high speed, low torque operation, working fluid passes through both motors 50*a*, 50*b* of motor unit 50 in series.

Figure 4A:
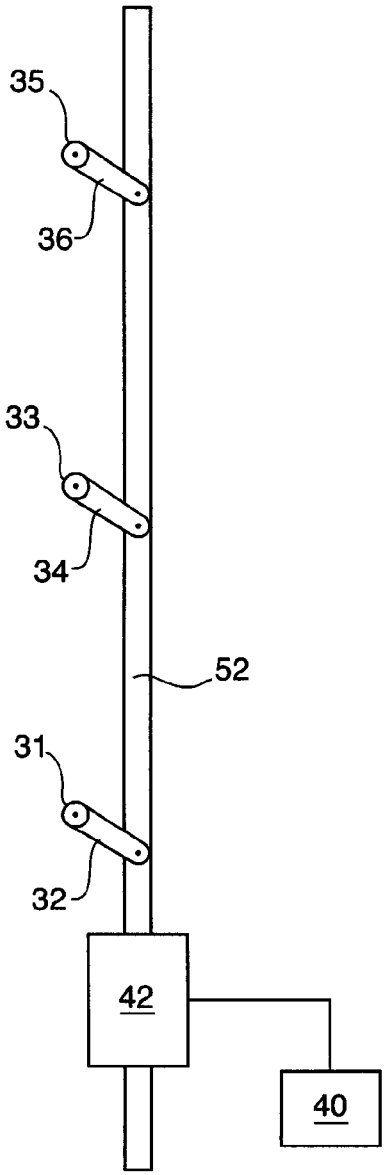
FIG. 4A is a schematic diagram of a first embodiment of actuation means in a first configuration.
Figure 4B:
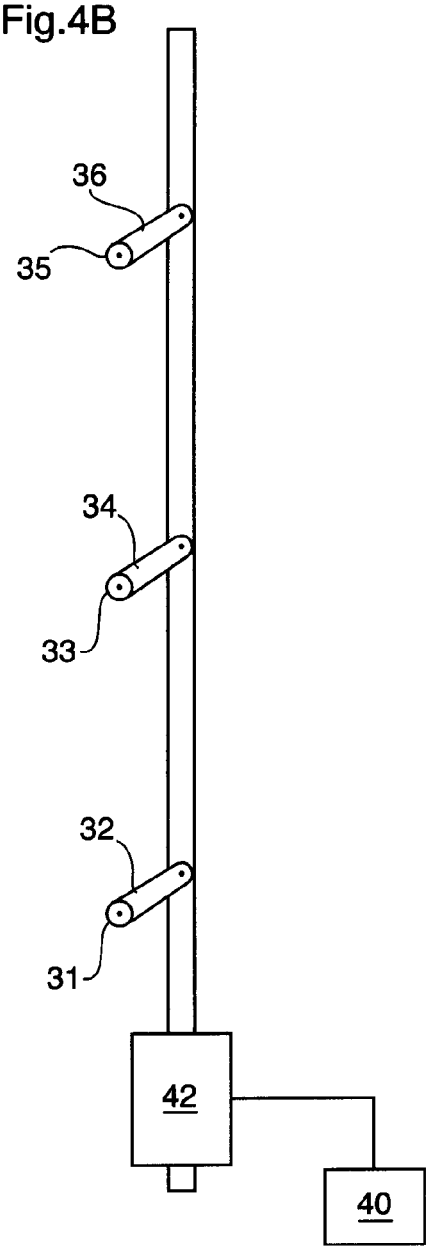
FIG. 4B is a schematic diagram of the actuation means of FIG. 4A in a second configuration.

Referring to FIG. 4A, actuation means 40 is shown for opening and closing valves 31, 33, and 35 to allow hydraulic manifold 30 to switch between a low speed, high torque configuration and a high speed, low torque configuration. Preferably, actuation means 40 comprises electrical actuation means. Actuation means 40 is operationally connected to device 42 through which bar 52 passes. Bar 52 is in mechanical communication with valves 31, 33, and 35 through linkages 32, 34, and 36, respectively. The balls of valves 31 and 35 are positioned in the same orientation while the ball of valve 35 is oriented 90 degrees thereto. In the low speed, high torque configuration, valves 31 and 35 are open and valve 33 is closed. When the high speed, low torque configuration is desired, actuation means 40 is activated to cause bar 52 to move a predetermined distance through device 42. The movement of bar 52 causes linkages 32, 34, and 36 to rotate and thereby cause valves 31, 33, and 35 to rotate so that valve 33 opens and valves 31 and 35 close (as shown in FIG. 4B). When the low speed, high torque configuration is desired again, actuation means 40 is deactivated and bar 52 returns to its original position. The return movement of bar 52 causes linkages 32, 34, and 36 to rotate and thereby causes valves 31, 33, and 35 to rotate so that valves 31 and 35 are opened and valve 33 is closed.

Figure 5A:
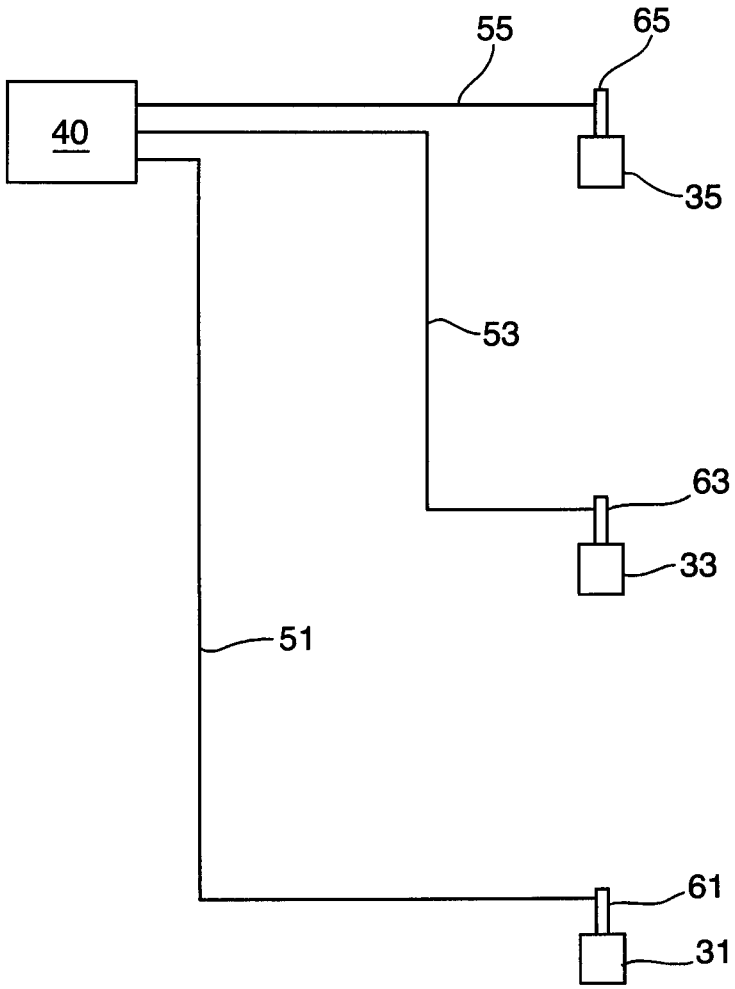
FIG. 5A is a schematic of a second embodiment of actuation means.

Referring to FIG. 5A, actuation means 40 is shown for opening and closing valves 31, 33, and 35 to allow hydraulic manifold 30 to switch between a low speed, high torque configuration and a high speed, low torque configuration. Preferably, actuation means 40 comprises electrical actuation means. In this embodiment, each of valves 31, 33, and 35 is coupled to an electrically activated solenoid means. Preferably, the electrically activated solenoid means comprise solenoid 61 coupled to valve 31, solenoid 63 coupled to valve 33, and solenoid 65 coupled to valve 35. Each solenoid 61, 63, and 65 receives a separate input from actuation means 40. Solenoid 61 is connected to actuation means 40 via lead 51, solenoid 63 is connected to actuation means 40 via lead 53, and solenoid 65 is connected to actuation means 40 via lead 55. In the low speed, high torque configuration, actuation means 40 actuates solenoids 61 and 65, through leads 51 and 55, to open valves 31 and 35. When the high speed, low torque configuration is desired, actuator means 40 is activated to actuate solenoid 63, through lead 53, to open valve 33, and discontinues actuating solenoids 61 and 65, causing valves 31 and 35 to close.

Figure 5B:
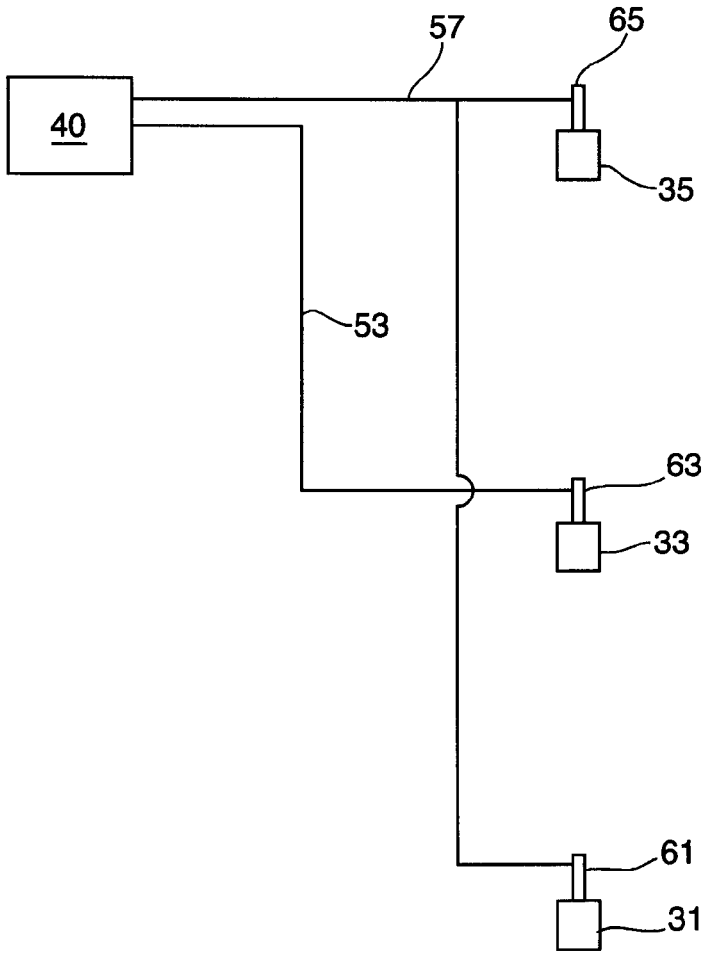
FIG. 5B is a variation of the second embodiment shown in FIG. 5A.

Referring to FIG. 5B, a variation of the leads connecting actuation means 40 to solenoids 61, 63, and 65 is shown. In this embodiment, solenoid 63 is connected to actuation means 40 via lead 53 and solenoids 61 and 65 are connected through common lead 57. In the low speed, high torque configuration, actuation means 40 actuates solenoids 61 and 65, through common lead 57, to open valves 31 and 35. When the high speed, low torque configuration is desired, actuator means 40 actuate solenoid 63, through lead 53, to open valve 33, and discontinues actuating solenoids 61 and 65, causing valves 31 and 35 to close.

The foregoing description of the disclosed embodiments is provided to enable any person skilled in the art to make or use the present invention. The scope of the claims should not be limited by the preferred embodiments set forth in the examples, but should be given the broadest interpretation consistent with the description as a whole. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". In addition, where reference to "fluid" is made, such term is considered meaning all liquids and gases having fluid properties.

For a complete definition of the invention and its intended scope, reference is to be made to the summary of the invention and the appended claims read together with and considered with the disclosure and drawings herein.

I claim:

1. A hydraulic manifold apparatus operable in a low speed, high torque configuration or a high speed, low torque configuration, said hydraulic manifold apparatus comprising:

a supply port adapted to receive pressurized working fluid from a hydraulic pump;

a first and second output port connectable to an intake of a hydraulic motor;

a first and second intake port connectable to an output of said hydraulic motor;

a first, second, and third actuable valve for controlling the flow of said working fluid through said hydraulic manifold apparatus;

actuation means including a first solenoid, a second solenoid, and a third solenoid for actuating said first actuable valve, said second actuable valve, and said third actuable valve, respectively, in said hydraulic manifold apparatus between a first configuration for low speed, high torque operation wherein said first actuable valve and said third actuable valve are open and said second actuable valve is closed, and a second configuration for high speed, low torque operation wherein said second actuable valve is open and said first actuable valve and said third actuable valve are closed; and a return port adapted to deliver working fluid to said hydraulic pump;

wherein in said first configuration, said working fluid exits said hydraulic manifold apparatus through said first output port and said second output port simultaneously and returns into said hydraulic manifold apparatus through said first intake port and said second intake port simultaneously to permit low speed, high torque operation of said hydraulic motor, and wherein in said second configuration, said working fluid exits said hydraulic manifold apparatus through said first output port, returns into said hydraulic manifold apparatus through said first intake port, exits said hydraulic manifold apparatus through said second output port, and returns into said hydraulic manifold apparatus through said second intake port to permit high speed, low torque operation of said hydraulic motor.

2. A hydraulic manifold apparatus operable in a low speed, high torque configuration or a high speed, low torque configuration, said hydraulic manifold apparatus comprising:

a supply port adapted to receive pressurized working fluid from a hydraulic pump;

a first and second output port connectable to an intake of a hydraulic motor;

a first and second intake port connectable to an output of said hydraulic motor;

a first, second, and third actuable valve for controlling the flow of said working fluid through said hydraulic manifold apparatus;

actuation means including a first solenoid for actuating said first actuable valve and said third actuable valve and a second solenoid for actuating said second actuable valve in said hydraulic manifold apparatus between a first configuration for low speed, high torque operation wherein said first actuable valve and said third actuable valve are open and said second actuable valve is closed, and a second configuration for high speed, low torque operation wherein said second actuable valve is open and said first actuable valve and said third actuable valve are closed; and a return port adapted to deliver working fluid to said hydraulic pump;

wherein in said first configuration, said working fluid exits said hydraulic manifold apparatus through said first output port and said second output port simultaneously and returns into said hydraulic manifold apparatus through said first intake port and said second intake port simultaneously to permit low speed, high torque operation of said hydraulic motor, and wherein in said second configuration, said working fluid exits said hydraulic manifold apparatus through said first output port, returns into said hydraulic manifold apparatus through said first intake port, exits said hydraulic manifold apparatus through said second output port, and returns into said hydraulic manifold apparatus through said second intake port to permit high speed, low torque operation of said hydraulic motor.

3. A hydraulic control system for controlling a topdrive motor in a drilling operation, comprising:

a supply means for receiving pressurized working fluid from a pump;

a first and second output means for connection to an intake of a hydraulic motor;

a first and second intake means constructed and arranged for connection to an output of said hydraulic motor;

a first, second, and third valve means, wherein said first valve means comprises a first valve coupled to electrically activated solenoid means; said second valve means comprises a second valve coupled to said electrically activated solenoid means; and said third valve means comprises a third valve coupled to said electrically activated solenoid means;

actuation means including electrical actuator means with a first electrical actuator for actuating said first valve and said third valve; and a second electrical actuator for actuating said second valve, the electrical actuator means for actuating said solenoid means so as to control said first, second, and third valve means between selecting an open and closed position and thus to control said hydraulic control system between a first, low speed, high torque configuration wherein said electrical actuator means is actuated so as to open said first valve and said third valve and close said second valve, and a second, high speed, low torque configuration wherein said electrical actuator means is actuated so as to cause opening of said second valve and closing of said first valve and said third valve;

a return means adapted to return working fluid to said pump;

wherein in said first configuration, said working fluid exits said hydraulic control system through said first output means and said second output means simultaneously and returns into said hydraulic control system through said first intake means and said second intake means simultaneously to permit low speed, high torque operation of said hydraulic motor, and in said second configuration, said working fluid exits said hydraulic control system through said first output means, returns into said hydraulic control system through said first intake means, exits said hydraulic control system through said second output means, and returns into said hydraulic control system through said second intake means to permit high speed, low torque operation of said hydraulic motor.

4. The hydraulic control system according to claim 3, wherein said actuation means comprises: a first solenoid coupled to said first valve; a second solenoid coupled to said second valve; and a third solenoid coupled to said third valve.

5. The hydraulic control system according to claim 3, wherein said electrical actuator means further comprises: a first electrical actuator for actuating said electrically activated solenoid means of said first valve; a second electrical actuator for actuating said electrically activated solenoid means of said second valve; and a third electrical actuator for actuating said electrically activated solenoid means of said third valve.

6. A hydraulic manifold operable in a low speed, high torque configuration or high speed, low torque configuration, said hydraulic manifold comprising:

a supply port adapted to receive pressurized working fluid from a pump;

a first and second output port connectable to an intake of a hydraulic motor;

a first and second intake port connectable to an output of said hydraulic motor;

a first, second, and third actuable valve for controlling the flow of said working fluid through said hydraulic manifold;

a first, second, and third electrical actuator for actuating said first actuable valve, said second actuable valve, and said third actuable valve, respectively, and a return port adapted to deliver working fluid to said pump;

wherein in said low speed, high torque configuration, said second actuable valve is closed and said first electrical actuator and said third electrical actuator actuate said first actuable valve and said third actuable valve, respectively, to open said first valve and said third valve and in said high speed, low torque configuration, said first actuable valve and said third actuable valve are closed and said second electrical actuator actuates said second actuable valve to open said second actuable valve.

7. A hydraulic control system for controlling a topdrive motor in a drilling operation, comprising:

a supply means for receiving pressurized working fluid from a pump;

a first and second output means for connection to an intake of a hydraulic motor;

a first and second intake means constructed and arranged for connection to an output of said hydraulic motor;

a first, second, and third valve means, wherein said first valve means comprises a first valve coupled to electrically activated solenoid means; said second valve means comprises a second valve coupled to said electrically activated solenoid means; and said third valve means comprises a third valve coupled to said electrically activated solenoid means;

actuation means including electrical actuator means with a first electrical actuator for actuating said first valve; and a second electrical actuator for actuating said second valve and said third valve, the electrical actuator for actuating said solenoid means so as to control said first, second, and third valve means between selecting an open and closed position and thus to control said hydraulic control system between a first, low speed, high torque configuration wherein said electrical actuator means is actuated so as to open said first valve and said third valve and close said second valve, and a second, high speed, low torque configuration wherein said electrical actuator means is actuated so as to cause opening of said second valve and closing of said first valve and said third valve;

a return means adapted to return working fluid to said pump;

wherein in said first configuration, said working fluid exits said hydraulic control system through said first output means and said second output means simultaneously and returns into said hydraulic control system through said first intake means and said second intake means simultaneously to permit low speed, high torque operation of said hydraulic motor, and in said second configuration, said working fluid exits said hydraulic control system through said first output means, returns into said hydraulic control system through said first intake means, exits said hydraulic control system through said second output means, and returns into said hydraulic control system through said second intake means to permit high speed, low torque operation of said hydraulic motor.

8. The hydraulic control system according to claim 7, wherein said actuation means comprises: a first solenoid coupled to said first valve; a second solenoid coupled to said second valve; and a third solenoid coupled to said third valve.

9. The hydraulic control system according to claim 7, wherein said electrical actuator means comprises: a third electrical actuator for actuating said electrically activated solenoid means of said third valve.

10. A hydraulic control system for controlling a topdrive motor in a drilling operation, comprising:

a supply means for receiving pressurized working fluid from a pump;

a first and second output means for connection to an intake of a hydraulic motor;

a first and second intake means constructed and arranged for connection to an output of said hydraulic motor;

a first, second, and third valve means;

actuation means for configuring said hydraulic control system between a first configuration wherein said first valve means and said third valve means are open while said second valve means is closed and a second configuration wherein said second valve means is open and said first valve means and said third valve means is closed, the actuation means including a first solenoid coupled to said first valve means; a second solenoid coupled to said second valve means; and a third solenoid coupled to said third valve means;

a return means adapted to return working fluid to said pump;

wherein in said first configuration, said working fluid exits said hydraulic control system through said first output means and said second output means simultaneously and returns into said hydraulic control system through said first intake means and said second intake means simultaneously to permit low speed, high torque operation of said hydraulic motor, and in said second configuration, said working fluid exits said hydraulic control system through said first output means, returns into said hydraulic control system through said first intake means, exits said hydraulic control system through said second output means, and returns into said hydraulic control system through said second intake means to permit high speed, low torque operation of said hydraulic motor.

11. The hydraulic control system according to claim 10, wherein said first valve means comprises a first valve and the first solenoid is electrically activated; said second valve means comprises a second valve and the second solenoid is electrically activated; and said third valve means comprises a third valve and the third solenoid is electrically activated.

12. The hydraulic control system according to claim 11, wherein the first configuration is a low speed, high torque configuration, and the second configuration is a high speed, low torque configuration.

13. The hydraulic control system according to claim 12, wherein said actuation means comprises: a first electrical actuator for actuating said first valve and said third valve; and a second electrical actuator for actuating said second valve.

14. The hydraulic control system according to claim 12, wherein said electrical actuator means comprises: a first electrical actuator for actuating said first valve; and a second electrical actuator for actuating said second valve and said third valve.

15. The hydraulic control system according to claim 10, wherein said electrical actuator means comprises: a first electrical actuator for actuating said first solenoid; a second electrical actuator for actuating said second solenoid; and a third electrical actuator for actuating said third solenoid.

16. The hydraulic control system according to claim 10, wherein said actuation means comprises an electrical actuator for actuating said first valve means, said second valve means, and said third valve means.

17. A hydraulic control system for controlling a topdrive motor in a drilling operation, comprising:

a supply means for receiving pressurized working fluid from a pump;

a first and second output means for connection to an intake of a hydraulic motor;

a first and second intake means constructed and arranged for connection to an output of said hydraulic motor;

a first, second, and third valve means;

actuation means for configuring said hydraulic control system between a first configuration wherein said first valve means and said third valve means are open while said second valve means is closed and a second configuration wherein said second valve means is open and said first valve means and said third valve means are closed, the actuation means comprising a first electrical actuator for actuating an electrically actuated solenoid means of the first valve means; a second electrical actuator for actuating an electrically actuated solenoid means of the second valve means; and a third electrical actuator for actuating an electrically actuated solenoid means of the third valve means;

a return means adapted to return working fluid to said pump;

wherein in said first configuration, said working fluid exits said hydraulic control system through said first output means and said second output means simultaneously and returns into said hydraulic control system through said first intake means and said second intake means simultaneously to permit low speed, high torque operation of said hydraulic motor, and in said second configuration, said working fluid exits said hydraulic control system through said first output means, returns into said hydraulic control system through said first intake means, exits said hydraulic control system through said second output means, and returns into said hydraulic control system through said second intake means to permit high speed, low torque operation of said hydraulic motor.

18. The hydraulic control system according to claim 17, wherein said first valve means comprises a first valve; said second valve means comprises a second valve; and said third valve means comprises a third valve.

19. The hydraulic control system according to claim 18, wherein the first configuration is a low speed, high torque configuration, and the second configuration is a high speed, low torque configuration.

20. The hydraulic control system according to claim 17, wherein the actuation means including a first solenoid coupled to said first valve means; a second solenoid coupled to said second valve means; and a third solenoid coupled to said third valve means.

* * * * *